US005647759A

United States Patent [19]

Lien

[11] Patent Number: 5,647,759

[45] Date of Patent: Jul. 15, 1997

[54] CHRISTMAS LAMP BULB FIXING SOCKET

[75] Inventor: Tzung-Min Lien, Miao Li Hsien, Taiwan

[73] Assignee: Chen Yu Enterprise Co., Ltd., Miao Li Hsien, Taiwan

[21] Appl. No.: 645,813

[22] Filed: May 14, 1996

[51] Int. Cl.[6] ..... H01R 13/627

[52] U.S. Cl. ..... 439/356; 439/699.2

[58] Field of Search ..... 439/356, 619, 439/699.2, 370–372

[56] References Cited

U.S. PATENT DOCUMENTS

| | | | |
|---|---|---|---|
| 1,760,693 | 5/1930 | Gustin | 439/356 |
| 4,970,632 | 11/1990 | Tseng | 439/699.2 |
| 4,999,751 | 3/1991 | Chen | 439/356 |
| 5,137,465 | 8/1992 | Chwang | 439/699.2 |
| 5,443,402 | 8/1995 | Huang | 439/699.2 |

*Primary Examiner*—Hien Vu

*Attorney, Agent, or Firm*—Morton J. Rosenberg; David I. Klein

[57] ABSTRACT

A Christmas lamp bulb fixing socket is provided that comprises a connecting socket provided to hold a bulb and an outer socket provided to hold the connecting socket. The connecting socket is connected with the outer socket by means of a protrusion extending therefrom for engagement with an affixing unit of the outer socket. Circumferential openings formed through the connecting socket are provided for engagement by corresponding convexly shaped protrusions of the outer socket that pass therethrough to firmly hold the bulb in the connecting socket.

1 Claim, 2 Drawing Sheets

CHRISTMAS LAMP BULB FIXING SOCKET

BACKGROUND OF THE INVENTION

A heretofore known Christmas lamp bulb fixing socket, as shown in FIG. 4, includes a connecting head 5 and a socket 6. connecting head 5 has a protrusion 51 on a top edge of an outward circumference thereof. The protrusion 51 is made of a flexible material such as a thin plastic, and has a hole 511 formed therethrough. The socket 6 has a protrusion 61 on a top edge of an outward circumference thereof, such that the protrusion 61 is fitted into the hole 511 to firmly connect both the connecting head 5 and the socket 6 after the head 5 is passed into the socket 6.

However, because the protrusion 51 is very thin and is frequently moved up and down through use, it loses its flexibility, and eventually can't be firmly fitted onto the protrusion 61. Moreover, the protrusions 51, 61 need to be specifically shaped with respect to the interval therebetween and curvature such that both can firmly connect, otherwise both can't mate very well. So, in terms of simplicity and efficiency, this kind of connection has disadvantages.

SUMMARY OF THE INVENTION

A Christmas lamp bulb fixing socket according to the present invention comprises a connecting socket and an outer socket. The connecting socket is provided to hold a bulb and has a protrusion with a hook shaped end on an outer circumference thereof and several openings disposed around a circumferential wall thereof. The outer socket is provided to hold the connecting socket and has an affixing unit on an outer circumference thereof and convexly shaped protrusions on an inner circumference thereof. The affixing unit has a hole. In assembly, the connecting socket is inserted into the outer socket, and the hook shaped protrusion is passed into the hole of the affixing unit such that the hook shaped end is detained under the affixing unit and the convexly shaped protrusions pass through the openings in the circumferential wall of the connecting socket. A bulb is inserted into the connecting socket and firmly held by the convexly shaped protrusions of the outer socket such that the bulb is kept from falling out or turning.

BRIEF DESCRIPTION OF THE DRAWINGS

The invention will be better understood by reference to the accompanying drawings, wherein.

DESCRIPTION OF THE PREFERRED EMBODIMENTS

Figure 1:
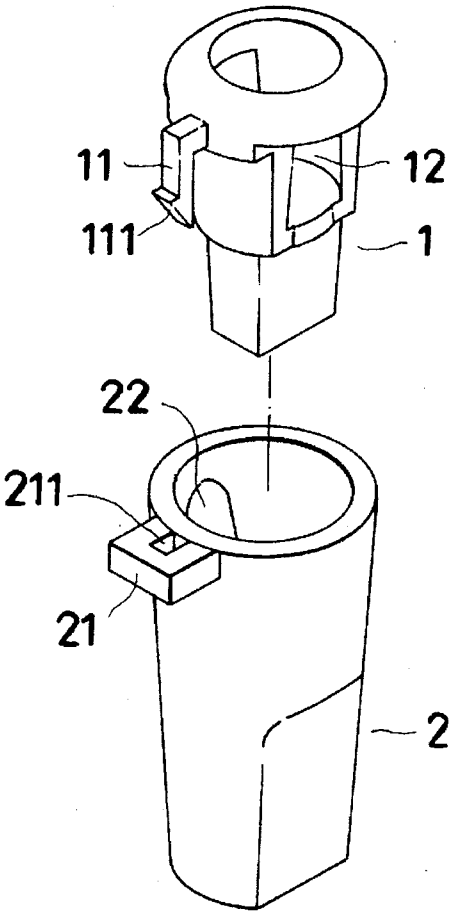
FIG. 1 is an exploded view of a Christmas lamp bulb fixing socket of the present invention.
Figure 4:
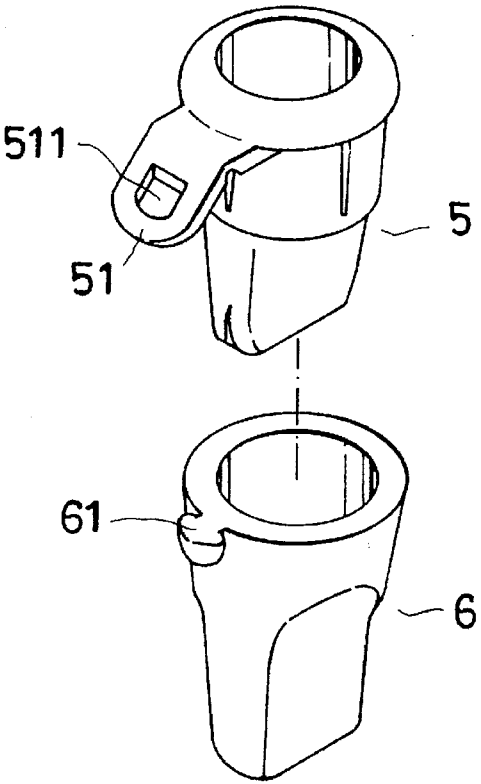
FIG. 4 (PRIOR ART)
FIG. 4 is an exploded view of a prior art Christmas lamp bulb fixing socket.
Figure 2:
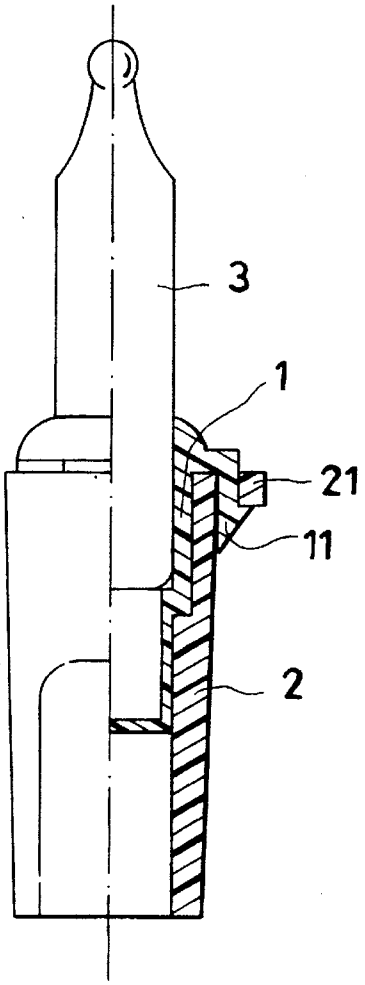
FIG. 2 is a longitudinal section view of the Christmas lamp bulb fixing socket of the present invention.
Figure 3:
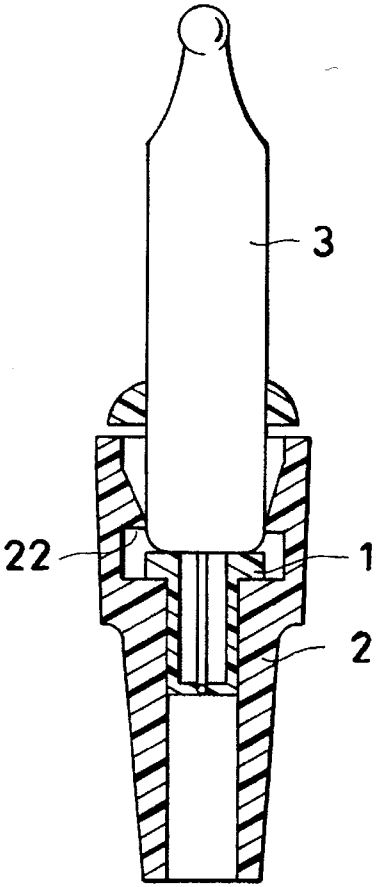
FIG. 3 is another longitudinal section view of the present invention.

A Christmas lamp bulb fixing socket according to the present invention is provided. Referring to FIG. 1, the fixing socket comprises a connecting socket 1 and an outer socket 2. The connecting socket 1 has a protrusion 11 on an upper part of an outer circumference thereof and several openings 12 formed through the circumferential wall thereof. The protrusion 11 has a hook shaped end 111.

The outer socket 2 has an affixing unit 21 on an outer circumference adjacent the top edge thereof, and convexly shaped protrusions 22 arranged to have positions corresponding to the openings 12 of the connecting socket 1. The affixing unit 21 has a hole 211. In assembly, the connecting socket 1 is passed into the outer socket 2 with the protrusion 11 fitted into the hole 211 of the affixing unit 21 and the convexly shaped protrusions 22 of the outer socket 2 fitted onto the openings 12 of the connecting socket 1. The hook-like end 111 is detained under the affixing unit 21 of the outer socket 2. Then a Christmas lamp bulb is fitted into the connecting socket 1 such that the bulb is firmly held by the convexly shaped protrusions 22 of the outer socket 2. The convexly shaped protrusions 22 hold the bulb and keep the bulb from falling out or turning, and aid in retention of the connecting socket 1 within the outer socket 2 by the passage of the convexly shaped protrusions 22 through the respective openings 12 of connecting socket 1.

From the above description, the fixing socket of the present invention can be understood to have the following advantages:

1. The bulb is kept from turning so wires connected thereto won't touch each other and short.
2. The connecting socket 1 only needs to be pushed downward to connect with the outer socket so the assemblage is very simple and efficient.

While the preferred embodiments of the invention have been described above, it will be recognized and understood that various modifications may be made therein and the appended claims are intended to cover all such modifications which may fall within the spirit and scope of the invention.

In the claims:

1. A Christmas lamp bulb fixing socket comprising:

a connecting socket provided for holding a bulb therein and having a protrusion extending outwardly and downwardly from an outer surface of a circumferential wall thereof and a plurality of openings formed through substantially flat sided wall portions of said circumferential wall, said protrusion having a hook shaped distal end; and, an outer socket provided for holding the connecting socket and having an affixing unit formed on an outer circumference thereof, said affixing unit having a hole formed therethrough to receive the protrusion of the connecting socket therein, said outer socket having a plurality of convexly shaped protrusions formed on an inner circumference thereof at positions corresponding to the openings in said circumferential wall of said connecting socket to pass through the openings for aiding in a retention of said connecting socket and holding the bulb firmly inside the connecting socket to keep the bulb from turning.

* * * * *